US006837727B2

(12) United States Patent
Migimatsu et al.

(10) Patent No.: US 6,837,727 B2
(45) Date of Patent: Jan. 4, 2005

(54) POWER SUPPLY SWITCH OF MOTOR VEHICLE

(75) Inventors: Yuji Migimatsu, Shizuoka (JP); Katsuaki Kawahata, Aichi (JP); Hirotake Sano, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/986,643

(22) Filed: Nov. 9, 2001

(65) Prior Publication Data

US 2002/0088695 A1 Jul. 11, 2002

(30) Foreign Application Priority Data

Nov. 9, 2000 (JP) ..... 2000-341978

(51) Int. Cl.[7] ..... H01R 13/64
(52) U.S. Cl. ..... 439/247; 439/377
(58) Field of Search ..... 439/247–249, 439/34, 38, 40, 139–141, 188, 189; 200/51.02, 51.07, 51 R

(56) References Cited

U.S. PATENT DOCUMENTS 5,334,032 A * 8/1994 Myers et al. ..... 439/140
5,437,558 A * 8/1995 Sakuraoka et al. ..... 439/140

* cited by examiner

*Primary Examiner*—Alex Gilman
(74) *Attorney, Agent, or Firm*—Armstrong, Kratz, Quintos, Hanson & Brooks, LLP

(57) ABSTRACT

The switch includes a base body side connector and a movable body side connector for connecting electrical circuits provided in a base body side and a movable body side of a motor vehicle. One of the base body side connector and the movable body side connector has a receptacle terminal while the other has a pin tab terminal. The other connector has a terminal cover piece for receiving an electrical contact portion provided in a free end side of the pin tab terminal. The terminal cover piece is slidable in engagement and disengage directions of the terminals. The terminal cover piece is urged by a resilient member parallel to an extended direction of the pin tab terminal. The resilient member is positioned between a flange of the terminal cover piece and a bottom surface of a housing of the movable body side connector.

4 Claims, 3 Drawing Sheets

POWER SUPPLY SWITCH OF MOTOR VEHICLE

BACKGROUND OF THE INVENTION

1. Field of the Invention

The present invention relates to a power supply switch of an auxiliary apparatus located a back door or a slide door of a vehicle like a motor vehicle for electrical connection to a power source of a base body side of the vehicle.

2. Related Art

A motor vehicle has various auxiliary apparatuses such as a rear wiper and a door lock located in a back door, a slide door, etc. For these apparatuses, various types of power supply switches have been proposed.

FIG. 5 shows a prior-art power supply switch 51 of a motor vehicle which is disclosed in Japanese Patent Application Laid-open No. 2000-62545. In FIG. 5, reference numeral 53 designates a base body side connector, and 52 designates a movable body side connector.

The base body side connector 53 has an insulating resin housing 71 and a plurality of receptacle terminals 65 adjacently parallel arranged in the housing 71. The housing 71 has an upper cover (not shown) and a lower cover (not shown).

The housing 71 is provided with openings 77 for insertion of pin tab terminals 55. Inside each opening 77, each receptacle terminal 65 is received. Each opening 77 is closed by a pair of synthetic resin made shutters 75 provided in a forward side of each receptacle terminal 65. The housing 71 is fixed by an inclined flange (not shown) to a vehicle body.

The receptacle terminal 65 of the base body side connector 53 is openably supported by a metal cylindrical shaft (support shaft) 76 and is urged by a coil spring (resilient member) 72 provided around the cylindrical shaft 76 in a closing direction thereof. The coil spring 72 has a coil portion 73 and a pair of legs 74 extended rearward from the coil portion 73.

The receptacle terminal 65 has a pair of contact pieces each constituted by a hinge plate portion (not shown), a side plate portion (spring receiving portion) 66 rising vertically from the hinge portion, an inclined portion 67 inclined forward from the side plate portion 66, and a contact portion 68 contiguous to the inclined portion 67.

A pair of the hinge portions overlap one another and are pressed by the coil portion 73 of the coil spring 72 on an electrical pole portion (not shown) in a side of the housing 71. The coil spring 72 urges the contact portions 68 and the hinge portions of the electrical pole portion (not shown). The electrical pole portion is connected to power supply lines (not shown) through a female connector portion (not shown).

In a forward end side of each receptacle terminal 65, there are provided the pair of shutters 75 which are opened together with the contact portions 68. Each shutter 75 has an inward inclined guide surface and a closing surface positioned at an inner end of the guide surface. In a closed state of the contact portions 68, the pair of shutters 75 contact with each other to prevent the entry of water drips or dust into the contact portion 68 through the opening 77 of the housing 71.

The movable body side connector 52 is constituted by an insulating resin housing 58, a tab terminal 55 resiliently urged in the housing 58 to extend forward, and a cushion 61 positioned outside an electrical contact portion 54 of the tab terminal 55. The cushion 61, which is made of rubber or the like, faces the base body side connector 53. The housing 58 has a front cover 57 and a rear cover 56. The tab terminal 55 is mounted while the cover 56 is removed from the housing 58.

In a base end side of the electrical contact portion 54 of the tab terminal 55, there are provided a spring retaining projection (not shown) and a spring receiving recess (not shown). Between the spring retaining projection and a spring retaining projection 59 of the cover 56, there is disposed a compression coil spring 60. The resilient force of the compression coil spring 60 is determined to be larger than the insertion force of the tab terminal 55 into the receptacle terminal 65. The tab terminal 55 moves rearward to compress the coil spring 60 when the tab terminal 55 receives an external force.

The tab terminal 55 has a connection portion (not shown) upwardly rising from the base side of the electrical contact portion 54. The connection portion is fitted with another terminal (not shown) connected to an electrical wire.

However, the extended tab terminal 55 of the prior-art power supply switch may disadvantageously receive an unintentional force which will undesirably bend the tab terminal, because the switch is used in a slide door or a back door which is often opened and closed for access to the inside of the vehicle. Furthermore, the tab terminal 55 is long in length and narrow in width so that the electrical connection thereof may be prevented due to an incorrect alignment with the associated receptacle terminal. A heavy tab terminal having a shorter length improves its strength but requires a larger space with a larger connector housing. Moreover, when a door mounted with the switch is opened, the exposed forward end of the tab terminal 55 may undesirably catch water drips or dust to cause an incorrect electrical connection or an unintentional shirt circuit.

SUMMARY OF THE INVENTION

In view of the drawback of the prior art, an object of the present invention is to provide a power supply switch for a motor vehicle, which requires no larger connector housing and protects a tab terminal of the switch from an unintentional external force. It is also prevented that the tab terminal catches water drips and dust.

For achieving the object, the present invention provides a power supply switch used in a motor vehicle, the switch including a base body side connector and a movable body side connector for connecting electrical circuits provided in the base body side and the movable body side. One of the base body side connector and the movable body side connector has a receptacle terminal while the other has a pin tab terminal. The other connector has a terminal cover piece for receiving an electrical contact portion provided in a free end side of the pin tab terminal The terminal cover piece is slidable in engagement and disengage directions of the terminals. The terminal cover piece is urged by a resilient member parallel to an extended direction of the pin tab terminal.

Thereby, in the disengaged state of the base body side connector and the movable body side connector, the tab terminal of the movable body side connector is received in an inner space of the connector housing in respect of a rear half of the terminal, while a forward half of the terminal is received in the guide hole of the terminal cover piece. Since the terminal cover piece is provided with the resilient member, an impact force at the engagement of both the connectors is absorbed. The tab terminal is exposed when the facing ends of both the connectors abut against each other. The abutment moves backward the terminal cover piece to cause the tab terminal to extend therefrom. The tab terminal, which extends along the guide hole of the terminal cover piece, is simultaneously inserted into the opposed receptacle terminal.

Thus, the tab terminal receives no unintentional external force, which eliminates a deformation or damage of the tab terminal. It is also prevented that the tab terminal will catch water drips and dust. Furthermore, the impact force at the abutment of the connectors is absorbed, maintaining a contact reliability thereof for a long time.

Preferably, the terminal cover piece is formed with a guide hole slidably receiving the pin tab terminal. Thereby, the tab terminal is received in the guide hole of the terminal cover piece and is guided by an inner surface of the guide hole, while the tab terminal is inserted into the receptacle terminal. Thus, incorrect alignment of the terminals is prevented and a buckling deformation of the tab terminal will be also eliminated.

Preferably, the terminal cover piece has a front surface facing the base body side, a rear end surface facing the movable body side, and an outer peripheral side surface connecting the front surface to the rear end surface. The outer peripheral side surface has a flange. The resilient member is positioned between a face of the flange and a bottom surface of the housing of the movable body side connector. Thereby, the flange of the terminal cover piece slides along an inner wall of the connector housing in engagement and disengagement directions of the terminals. Thus, the terminal cover piece can slide stably.

Preferably, a forward end of the pin tab terminal is located rearward from the front surface of the terminal cover piece during a disengaged state of the base body side connector and the movable body side connector. Thereby, the tab terminal is not exposed in a state where the base body and movable body side connectors are disengaged, for example, when a back door of the vehicle is open. Thus, the tip of the tab terminal will not be harmful to a passenger of the vehicle.

Preferably, the housing is unitarily formed with another flange at an inner wall thereof for abutting against the flange of the terminal cover piece. Thereby, the terminal cover piece flange abuts against the stopper flange of the connector housing to limit a further advance of the terminal cover piece in the tab terminal insertion direction, while the tab terminal is received in the terminal cover piece not to extend therefrom. The terminal cover piece slides since an outer side surface of the terminal cover piece is slidable for the flange of the connector housing. Thus, the front surface of the terminal cover piece can stop at a predetermined position so that the terminals can reliably contact with each other. The terminal cover piece can slide in a stable state.

Preferably, a resilient member is fitted with a rear end of the tab terminal such that the resilient member urges the tab terminal in an insertion direction of the tab terminal. Thereby, the tab terminal is urged by the resilient member, so that the resilient member is compressed to absorb an impact force for the tab terminal when an unintentional external force is exerted on the tab terminal. Thus, a further improvement of reliable electrical connection thereof is achieved.

DETAILED DESCRIPTION OF PREFERRED EMBODIMENTS

Figure 1:
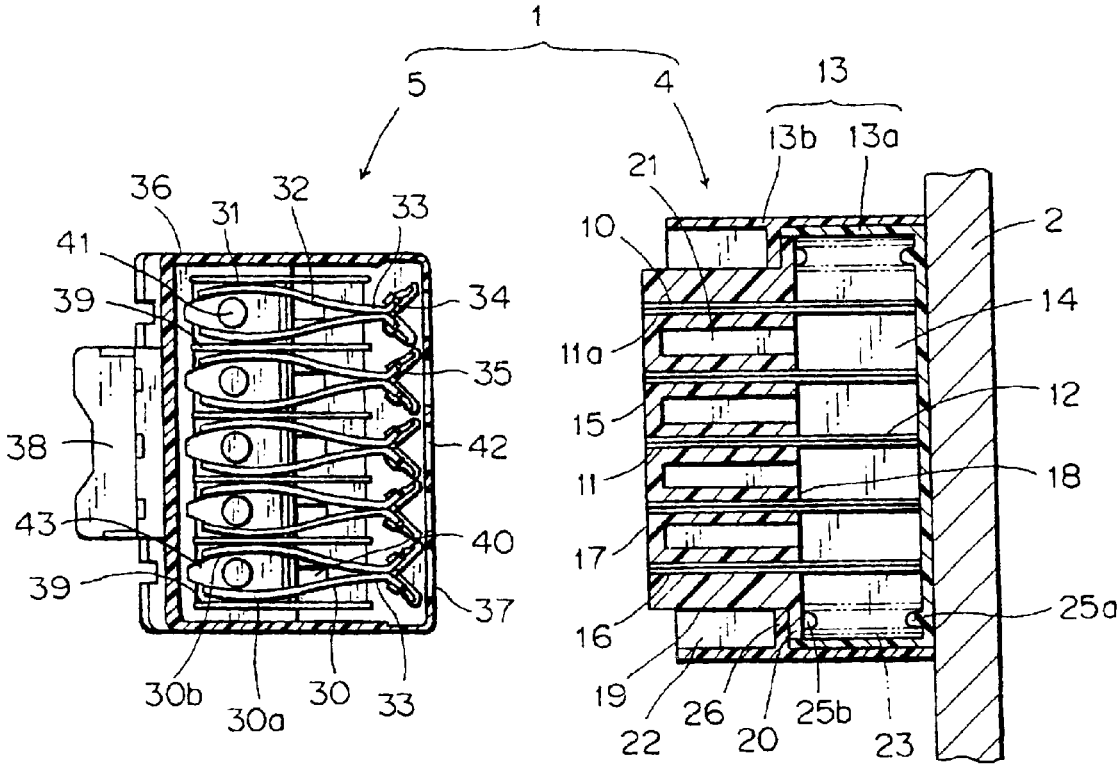
FIG. 1 is a sectional view showing a first embodiment of a power supply switch according to the present invention.

Referring to the accompanied drawings, embodiments of the present invention will be discussed in detail. FIGS. 1 and 2 shows a first embodiment of a power supply switch of the present invention.

A motor vehicle has a door panel 2 provided with a movable body side connector 4. The movable body side connector 4 is constituted by a housing 13 having a fore end opening space 22, a plurality of tab terminals 10 received in an inner space 14 of the housing 13, and a terminal cover piece 15 accommodating a forward half 11 of each tab terminal 10 to protect it.

The housing 13 has a longitudinally U-shaped cover 13*a* and a case 13*b* engaged with the cover 13*a*. In this embodiment, the cover 13*a* and the case 13*b* are formed in separate bodies, which is easy in molding thereof. However, they may be unitarily formed. The cover 13*a* and the case 13*b* are made of an insulating synthetic resin material.

The tab terminals 10 are spaced in parallel from each other. Like a cantilever beam, the tab terminal 10 has a base end fixed to a wall of the cover 13*a* and a free forward end.

The terminal cover piece 15 is substantially a block having a front surface 17 facing a base body side of the vehicle, a rear end surface 18 facing the movable body side, and a peripheral side wall 19 connecting an outer edge of the front surface 17 to an outer edge of the rear end surface 18. The peripheral side wall 19 is unitarily provided with a flange 20 at a rear end thereof. The terminal cover piece 15 is formed with a slit recess 21 at a rear end thereof between adjacent ones of the guide holes 16. The slit recess decreases the weight of the terminal cover piece.

Between the flange 20 and a rear wall of the housing 13, a compression coil spring (resilient member) 23 is mounted in a compressed state. The compression coil spring 23 moves the terminal cover piece 15 to slide it parallel to an insertion direction of the tab terminal 10. The compression coil spring 23 is positioned between a spring retaining projection 25*b* formed on an end surface of the flange 20 and a spring retaining projection 25*a* formed on an end surface of the cover 13.

The terminal cover piece 15 functions as a cushion by the compression coil spring 23 to absorb an impact force at the engagement of the base body side connector 5 with the movable body side connector 4, for example, at closure of a door. Therefore, unlike the prior art, it is unnecessary to provide a rubber cushion in the opening space 22 of the movable body side connector 4 for abutment against the base body side connector 5. This is advantageous to reduce parts in number. Such a cushion is not required but a drip-proof packing is preferably provided.

The terminal cover piece 15 receives the forward half 11 of the tab terminal 10 to slidably support it and is formed with a straight through guide hole 16 extended from the front surface 17 to the rear end surface 18. The tab terminal 10 can advance through the guide hole 16 of the terminal cover piece 15 to be inserted straight into the receptacle terminal 30 with no deformation of the tab terminal 10. That is, neither incorrect alignment nor buckling of the terminals occurs.

As described above, the terminal cover piece 15 is urged by the compression coil spring 23 to slide forward till it is stopped by a flange 26 extended from an inner wall of the connector housing 13. In the stopped position, the tab terminal 10 is located rearward from the front surface 17 of the terminal cover piece 15 not to be exposed externally. Additionally, the movable body side connector 4 is correctly positioned for a sure engagement of the connectors.

Meanwhile, the base body side connector 5 is constituted by another terminal 38 for electrical connection to a power source provided in the base body side, a box-shaped insulating housing 36 contiguous to the terminal 38, and a plurality of receptacle terminals 30 mounted in an inner space 44 of the housing 36.

The receptacle terminal 30 has a pair of contact pieces 30*a*, 30*b* so as to be opposed to the tab terminal 10. Each receptacle terminal 30 has a hinge portion (not shown) to turnably support the pair of contact pieces 30*a*, 30*b*. The contact pieces 30*a*, 30*b* each have a forwardly inclined arm 32 contiguous to the hinge portion, a contact portion 33 contiguous to the arm 32 to be able to contact the tab terminal 10, and a guide portion 34 inclined outward from the contact portion 33. The receptacle terminal 30 is made of an electrically conductive metal plate by stamping and bending.

The hinge portion has a bottom plate (not shown) and a side plate portion 31. The bottom plate has a center hole through which a cylindrical shaft 41 is provided such that the contact pieces 30*a*, 30*b* are turnable around the shaft. The side plate portion 31 is outwardly urged by a coil spring 43.

The side plate portion 31 is abutting against a partition 39 standing in the housing 36 so that a resilient force of the coil spring 43 is appropriately adjusted. An unduly large resilient force of the coil spring 43 restricts the insertion of the tab terminal 10 between the contact portions 33 and reduces a useful life of the contact portion 33 due to a friction wear thereof. On the contrary, an insufficient resilient force of the coil spring 43 causes an unreliable electrical connection of the contact portion 33. The coil spring 43 is fixed in the same way as the prior art, which will not be discussed again.

In front of of the guide portions 34, there are provided a pair of shutters 35. The shutters 35 are openable together with the contact portions 33. The shutters 35 have a pair of guide surfaces inclined inward and a pair of closing surfaces each positioned at an inner end of one of the guide surfaces. The guide surfaces correct miss alignment of the tab terminal 10.

When the motor vehicle door is opened, the shutters 35 close to prevent the entry of water drips and dust from the opening 42 into the inner space 44 of the housing 36. Furthermore, unintentional entry of water drips will be discharged from a drain hole 40. The shutters 35 are attached to the receptacle terminal by engagement hooks in the same way as the prior art.

The receptacle terminals 30 are spaced from each over by partitions 39. The partition 39 abuts against the side plate portion 31 of the receptacle terminal 30 to resist to the urging force of the coil spring 43. This adjusts a pinching force exerted on the tab terminal 10 by the contact portions 33 of the receptacle terminal 30, allowing a smooth insertion of the tab terminal 10.

Figure 2A:
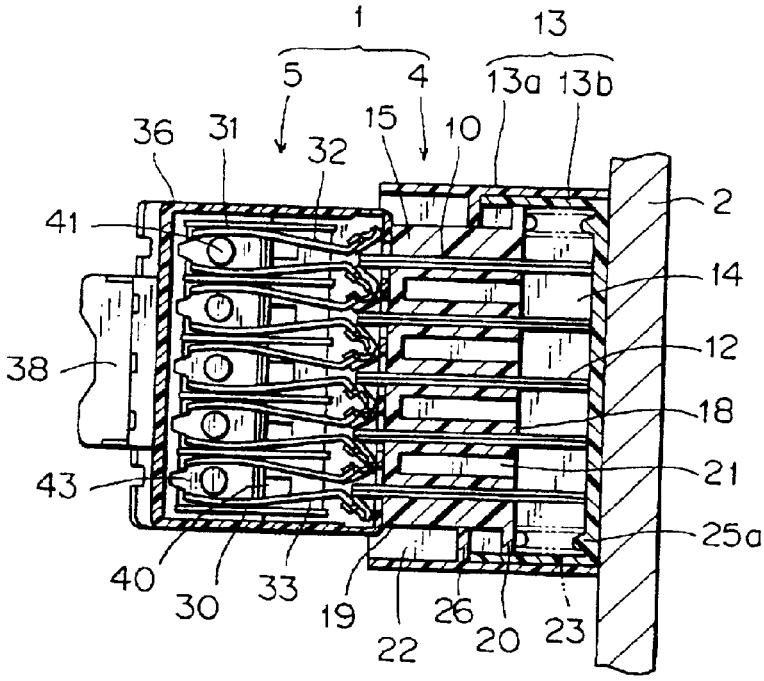
FIGS. 2A and 2B each are a sectional view showing a connection step of the power supply switch of FIG. 1.
Figure 2B:
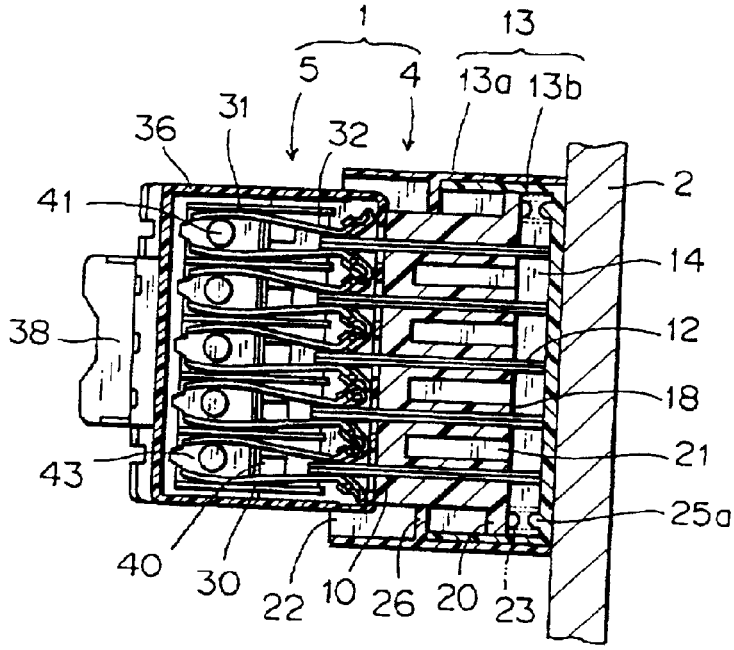

As illustrated in FIG. 2, when the motor vehicle door id closed, each tab terminal 10 of the movable body side connector 4 contacts each receptacle terminal 30 of the base body side connector 5, so that a base body side power circuit is electrically connected to an electrical circuit of an auxiliary apparatus provided in the movable body side. FIG. 2A shows an initial engagement state of the connectors, if and FIG. 2B shows a completed engagement state of the connectors, for example, when the vehicle door is closed.

In a disengaged state of the connectors (in an open state of the vehicle door) of FIG. 1, a rear half 12 of the tab terminal 10 of the movable body side connector 4 is received in the inner space 14 of the housing 13, while the forward half 11 is received in the guide hole 16 of the terminal cover piece 15. In the initial engagement state of the connectors of FIG. 2A, the terminal cover piece 15 moves rearward to externally expose the tab terminal 10 by the abutment of the front surfaces 17, 37 of the connectors since the terminal cover piece 15 can slide parallel to the terminals.

A further forward movement of the movable side connector, as illustrated in FIG. 2B, causes the forward half 11 of the tab terminal 10 to be exposed from the terminal cover piece 15, so that the tab terminal 10 is inserted between the opposed contact portions 33 of the receptacle terminal 30 to be pinched thereby. Meanwhile, the front surfaces 17, 37 of the connectors are abutting against each other. However, there is an opening space 22 in an outer peripheral side of the connectors, which may cause an undesirable entry of water drips. To prevent the drip entry, the opening space 22 is sealed by a packing as mentioned already.

Figure 3:
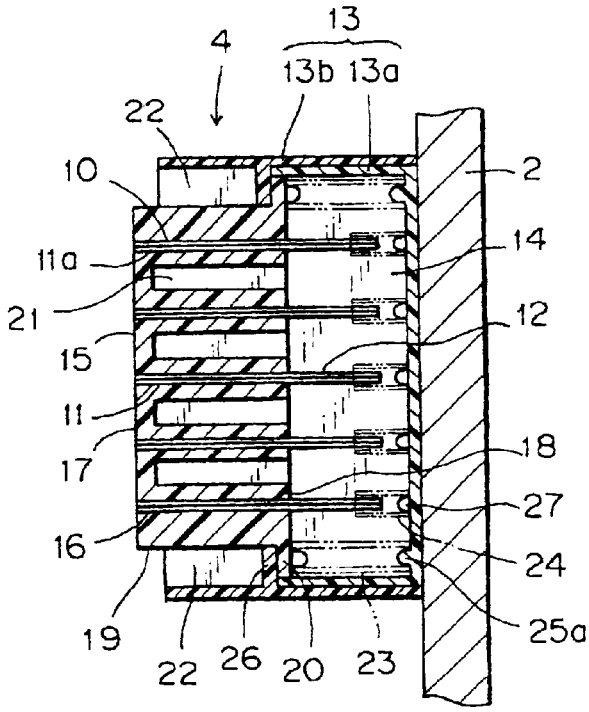
FIG. 3 is a sectional view showing a second embodiment of a power supply switch according to the present invention.
Figure 4:
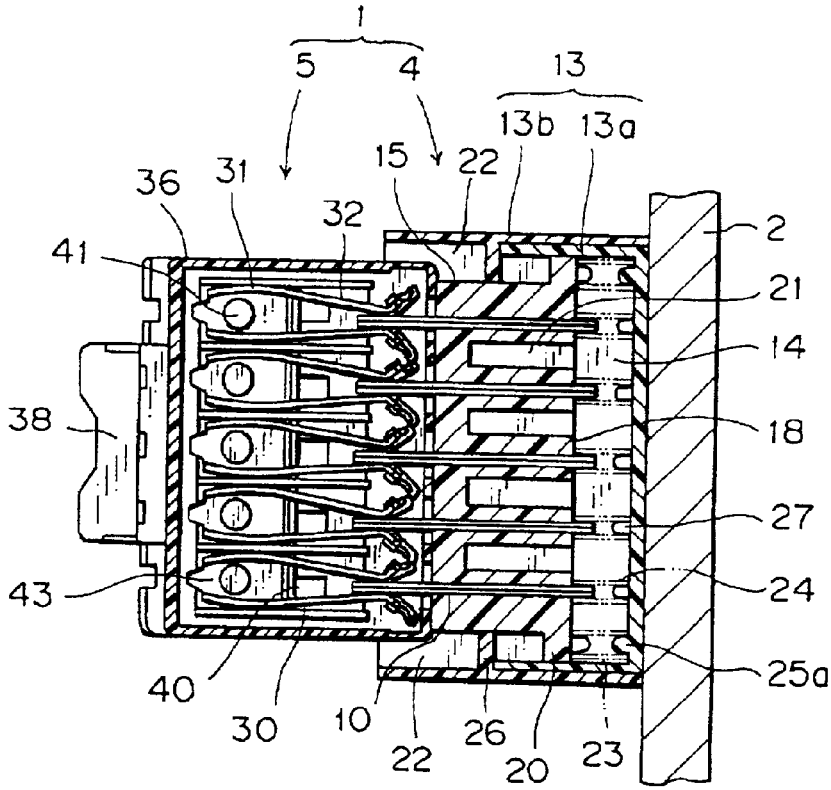
FIG. 4 is a sectional view showing a connection step of the power supply switch of FIG. 3.
Figure 5:
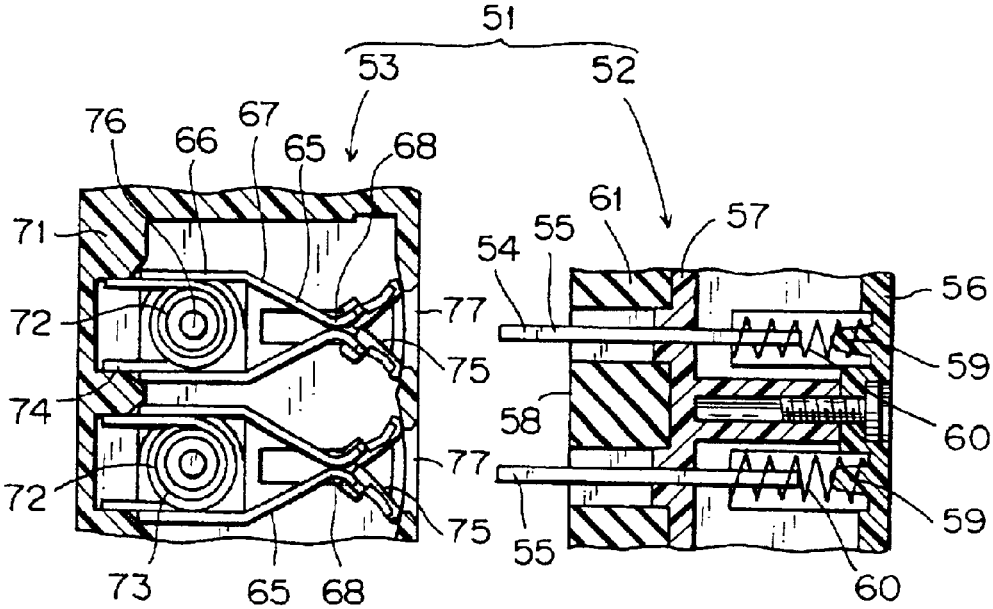
FIG. 5 PRIOR ART
FIG. 5 is a sectional view showing an example of a prior-art power supply switch.

FIGS. 3 and 4 show a second embodiment of a power supply switch according to the present invention. The second embodiment has a movable body side connector 4 of which a tab terminal 10 is resiliently supported in a longitudinal direction thereof. The resilient support is different from the configuration of the first embodiment.

The tab terminal 10 is formed with a spring retaining projection (not shown) and a spring receiving cut-out at a base end thereof. Between the spring retaining projection of the base end and a spring retaining projection 27 of the housing 13, a compression coil spring 24 (resilient member) is mounted. Thereby, the tab terminal 10 can move backward to compress the compression coil spring 24 when an unintentional force is exerted on the tab terminal 10. The compression coil spring 24 provides a resilient force larger than the insertion force of the tab terminal 10 into the receptacle terminal 30. The larger resilient force imposes no restriction for the insertion of the tab terminal 10. The other configuration of the second embodiment is the same as that of the first embodiment, which will not be discussed again.

What is claimed is:

1. A power supply switch used in a motor vehicle, the switch comprising a base body side connector and a movable body side connector for connecting electrical circuits provided in a base body side and a movable body side of the vehicle, wherein one of the base body side connector and the movable body side connector has a plurality of receptacle terminals while the other has a plurality of pin tab terminals, the other connector having a terminal cover piece for receiving an electrical contact portion provided in a free end side of each of the pin tab terminals, the terminal cover piece being slidable in engagement and disengage directions of the terminals, the terminal cover piece urged by a resilient member parallel to an extended direction of the pin tab terminal, wherein the terminal cover piece is formed with a plurality of guide holes each slidably receiving each of the pin tab terminals, and the terminal cover piece is formed with a recess between the guide holes for reducing weight of the terminal cover piece, wherein a forward end of each of the pin tab terminals is located rearward from the front surface of the terminal cover piece during a disengaged state of the base body side connector and the movable body side connector.

2. The switch as claimed in claim 1, wherein the terminal cover piece has a front surface facing the base body side, a rear end surface facing the movable body side, and an outer peripheral side surface connecting the front surface with the rear end surface, the outer peripheral side surface having a flange, the resilient member positioned between a face of the flange and a bottom surface of a housing of the movable body side connector.

3. The switch as claimed in claim 2, wherein the housing is unitarily formed with another flange at an inner wall thereof for abutting against the flange of the terminal cover piece.

4. The switch as claimed in claim 1, wherein another resilient member is fitted at a rear end of each of the tab terminals such that the resilient member urges the tab terminal in an insertion direction of the tab terminal.

* * * * *